US006692587B2

(12) United States Patent
Ro et al.

(10) Patent No.: US 6,692,587 B2
(45) Date of Patent: Feb. 17, 2004

(54) CR-BASE HEAT RESISTING ALLOY

(75) Inventors: Yoshikazu Ro, Ibaraki (JP); Hiroshi Harada, Ibaraki (JP); Yutaka Koizumi, Ibaraki (JP); Toshiharu Kobayashi, Ibaraki (JP); Eisuke Bannai, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 0 days.

(21) Appl. No.: 10/090,726

(22) Filed: Mar. 6, 2002

(65) Prior Publication Data

US 2002/0129878 A1 Sep. 19, 2002

(30) Foreign Application Priority Data

Mar. 7, 2001 (JP) ..... 2001-064057

(51) Int. Cl.[7] ..... C22C 27/06
(52) U.S. Cl. ..... 148/423; 420/428
(58) Field of Search ..... 420/428, 430, 420/433; 148/423

(56) References Cited

U.S. PATENT DOCUMENTS 3,999,985 A * 12/1976 Jones et al. ..... 420/448
6,254,660 B1 * 7/2001 Bernard et al. ..... 75/252
6,306,524 B1 * 10/2001 Spitsberg et al. ..... 428/621

FOREIGN PATENT DOCUMENTS

JP 63086845 A * 4/1988 ..... C22C/9/00
JP 04-000704 A * 1/1992 ..... C22C/27/06
JP 06-314617 A * 11/1994 ..... C23C/14/06
JP 1129337 * 10/1999 ..... C22C/27/06
JP 2001-158931 A * 6/2001 ..... C22C/27/06

OTHER PUBLICATIONS

Butylenko et al., "Coexistence of antiferromagnetism and superconductivity in the chromium–rhenium system", 1972, from Metallofizika, No. 40, 61–4.*

Ro et al., "Development pf Cr–base alloys and their compressive properties", Mar. 11, 2002, from Scripta Materialia, vol. 46, issue 5, pp. 331–335.*

Derwent Acc. No. 1992–053858 for JP 04000704 A published Jan. 6, 1992 by Tokin Corp. Abstract.*

ACS Doc. No. 120:57338, abstract from Fizika Metallov i Metallovedenie, 85(2), pp. 78–85, 1998 by Baklanova et al.*

ACS Doc. No. 122:203647, abstract from JP 06314617 A2 by Hashimoto et al, Aug. 8, 1994.*

ACS Doc. No. 77:170549, abstract from Metallofizika, No. 40 pp. 61–64, 1972 by Butylenko et al.*

ACS Doc. No. 92:63145, abstract from Metalloved. Term. Obrab. Met. (11), pp. 12–15, 1979 byMirotvorskii et al.*

* cited by examiner

*Primary Examiner*—Roy King
*Assistant Examiner*—Harry D. Wilkins, III
(74) *Attorney, Agent, or Firm*—Wenderoth, Lind & Ponack, L.L.P.

(57) ABSTRACT

There is provided a Cr-base heat resisting alloy, which contains Cr as a main component element and at least one element selected from the group consisting of Re and W in amount of from 1 atomic % to 40 atomic %.

5 Claims, 1 Drawing Sheet

CR-BASE HEAT RESISTING ALLOY

BACKGROUND OF THE INVENTION

1. Field of the Invention

This invention relates to a Cr-base heat resisting alloy. More particularly, this invention relates to a Cr-base heat resisting alloy with excellent high temperature strength and room temperature ductility, which can be used under a high temperature environment of 1100° C. or more and is hopeful for adapting to a material for stationary or moving blades of a gas turbine.

2. Description of the Prior Art

As a heat resisting material for structural purposes such as stationary or moving blades of a gas turbine, there has widely been used Ni-base alloys or Co-base alloys. However, these alloys are relatively high in cost and their expiration temperature is restricted to around 1100° C. on account of a limitation in terms of their melting point, etc. Since thermal efficiency of a gas turbine is remarkably improved by raising a temperature at an inlet of the gas turbine, development of a heat resisting alloy for structural purpose that can be used at higher temperatures is demanded.

As one of the materials that is the most excellent in high temperature strength and relatively low in cost, pure Cr is known. However, in the case where the amount of Cr is around 60 atomic %, conventional Cr and Cr-base alloys exhibit not only room temperature brittleness but also almost little ductility. Therefore, they cannot be processed after melting and solidification and are impossible to adapt to a material for structural purposes. A Fe—Cr base alloy that has an excellent balance of strength and ductility in a high temperature range of around 1000° C. is proposed. However, high temperature strength and ductility of the Fe—Cr base alloy are not satisfactory compared with those of a Ni-base alloy. In addition, ductility and high temperature strength of the Fe—Cr base alloy are seriously damaged by impurities and therefore, the total amount of impurities is suppressed to 60 mass ppm or less. The Fe—Cr base alloy cannot be made from raw materials containing impurities at a commercial level, but can be made from raw materials especially high in purity. Consequently, the Fe—Cr base alloy is high in cost and much care is needed during production.

SUMMARY OF THE INVENTION

This invention has an object to provide a Cr-base heat resisting alloy with excellent high temperature strength and room temperature ductility, which can be used under a high temperature environment of 1100° C. or more and is hopeful for adapting to a material for stationary or moving blades of a gas turbine.

According to an aspect of this invention, there is provided a Cr-base heat resisting alloy, which contains Cr as a main component element and at least one element selected from the group consisting of Re and W in amount of from 1 atomic % to 40 atomic %.

A 0.2% yield strength at 1200° C. of the Cr-base heat resisting alloy is 500 MPa or more.

The Cr-base heat resisting alloy is, for example, made by the following process:

Cr, Re and W that contain C, N, O and S as impurities, each of which contains such impurities in a total amount of 400 mass ppm or less, 1000 mass ppm or less, and 300 mass ppm or less, are used a raw material. A mixture of Cr and at least one element of Re and W in amount from 1 atomic % to 40 atomic % is made molten and solidified according to a usual manner.

That and other objects, features and advantages of the invention will become more apparent upon reading of the following detailed specification and drawing, in which:

DETAILED DESCRIPTION OF THE INVENTION

Figure 1:
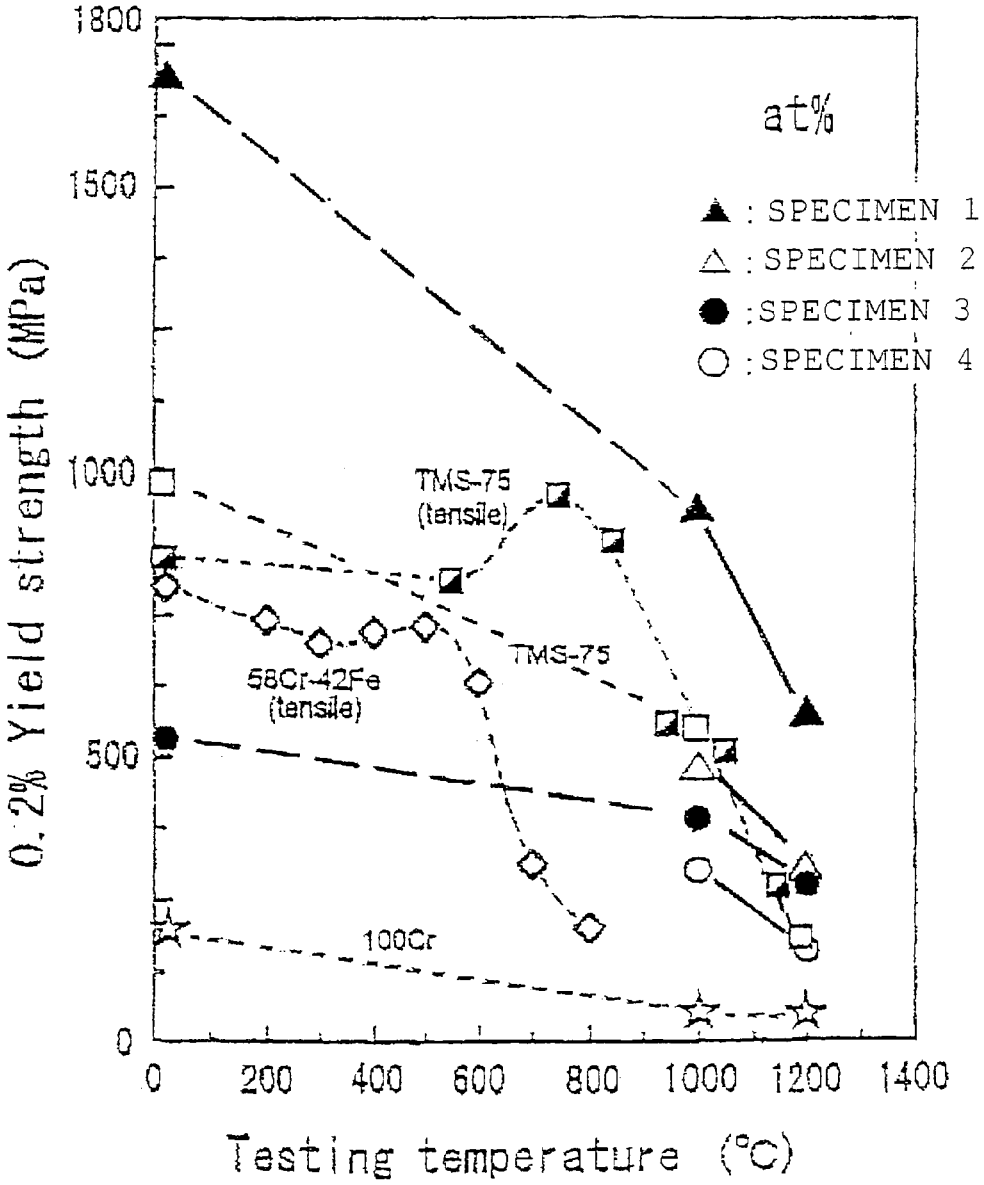
FIG. 1 is a graph illustrating results of static compression tests that were conducted on a Cr-base heat resisting alloy of this invention and TMS-75 and 58 Cr-42 Fe alloys for comparison.

A Cr-base heat resisting alloy of this invention contains Cr as a main component element and at least one element selected from the group consisting of Re and W in amount of from 1 atomic % to 40 atomic %. Namely, the Cr-base heat resisting alloy is an alloy containing Re or W, or a mixture of both in amount of from 1 atomic % to 40 atomic % as an element X for strengthening by solid solution in a Cr—X binary alloy.

Cr as a main component element, which has a higher melting point than that of Ni, makes high temperature strength and a creep property excellent. Cr is also inexpensive because it is one of the abundant natural resources. In this invention, strengthening element by solid solution, which is added to Cr, is Re or W, each of which exhibits a sufficiently high strength even at 1100° C. or more, has sufficiently excellent corrosion resistance and oxidation resistance at high temperatures and is not too expensive. Both Re and W have high melting point and large atomic weight and therefore, they serve to raise a melting point of a Cr-base alloy and suppress diffusion that is one of the causes of high temperature deformation. In this invention, Re or W, or a mixture of both is contained in amount of from 1 atomic % to 40 atomic %.

In the case where the amount of Re or W, or a mixture of both is less than 1 atomic %, the above-mentioned effects are not obtained.

In the case where the amount of Re exceeds 40 atomic %, a σ phase ($Cr_2Re_3$) that is one of the causes of brittleness is formed at a temperature of 1000° C. or more.

In the case where the amount of W exceeds 40 atomic %, oxidation resistance at high temperatures remarkably deteriorates. Therefore, the amount of Re or W, or a mixture of both is from 1 atomic % to 40 atomic %.

In this invention, a total amount range of impurities such as C, N, O and S, which are contained in a raw material, is widely permissive as follows; 400 mass ppm or less in Cr, 1000 mass ppm or less in Re and 3000 mass ppm or less in W. The Cr-base heat resisting alloy does not need any highly pure raw materials and therefore, the Cr-base heat resisting material of this invention is made from the above-mentioned raw materials and can be easily made by melting and solidification such as a usual manner.

As above-mentioned, a Cr-base heat resisting alloy of this invention does not require any specific or expensive additive element and consists essentially of a lesser number of elements. The Cr-base heat resisting alloy has a room temperature ductility and high temperature strength that are equal to or higher than those of the existing Ni-base alloys. 0.2% yield strength at 1200° C. of the Cr-base heat resisting alloy attains to 500 MPa or more. Accordingly, stationary or moving blades of a gas turbine, which is made from the Cr-base heat resisting alloy, can be used at higher temperatures and will be hopeful for improving thermal efficiency and suppression of exhausted carbon dioxide gas.

In the Cr-base heat resisting alloy of this invention, Re or W can partially be replaced by an element such as Nb, Mo, Hf or Ta that is usually added to Ni-base alloys for strengthening. The amount of replacement is up to one half of the amount of Re or W. Further, in the case of using the Cr-base heat resisting in a polycrystalline state, at least one element selected from the group consisting of C in amount of up to 0.5 atomic %, B in amount of up to 0.5 atomic % and Zr in amount of up to 0.5 atomic % can be added for strengthening grain boundaries.

Hereinafter, the Cr-base heat resisting alloy of this invention will be disclosed more in detail by way of several examples.

EXAMPLES

Using raw materials, each of which contains impurities at a commercial level, the following four kinds of Cr-base heat resisting alloys were made by arc dissolution and formed into a button-shaped mass whose weight is from 40 g to 90 g. The alloys were 70 Cr-30 W(specimen 1), 90 Cr-10 W(specimen 2), 70 Cr-30 Re(specimen 3) and 90 Cr-10 Re(specimen 4) in atomic %.

The amount of Cr in each of the specimens 1 to 4 were measured. As a result, in the specimens 1 and 3, the amount of Cr was approximately 40 mass % and in the specimens 2 and 4, approximately 70 mass %.

From these specimens, cylindrical testing pieces, each of which has a diameter of 2.5 mm to 3 mm and a length of 2.5 mm to 6 mm were prepared. The specimens 1 and 3 were subjected to a static compression test both at a room temperature (24° C.) and at high temperatures (1000° C. and 1200° C.). On the other hand, the specimens 2 and 4 were subjected to such a test only at high temperatures. 0.2% yield stress was measured by preserving a strain rate of $2.7\times10^{-4}$/s and high temperature strength was evaluated based on the 0.2% yield stress obtained. The relationships between the testing temperature and the yield strength obtained are shown in FIG. 1.

For comparison, high temperature strength (yield strength) of a TMS-75 alloy that has been the most excellent high temperature strength among the existing Ni-base single crystal heat resisting alloys and high temperature strength (yield strength) of a 58 Cr-42 Fe alloy are incorporated into FIG. 1.

It is confirmed that specimens 1 and 2 exhibit much higher strength than that of the existing alloy in a temperature range of from 1000° C. to 1200° C. It is also confirmed that the specimen 3 exhibits sufficiently higher strength than that of the existing alloy at 1200° C. and that the specimen 4 exhibits almost the same strength as that of the existing alloy. In addition, load strain of the specimens 1 to 4 is 3% to 8%, and it was confirmed that breakage due to brittleness or brittleness caused by nitrogen did not occur in any specimen.

With respect to compression ductility at room temperature, the specimen 1 has around 20% and the specimen 3 has around 30%.

Of course, this invention is not limited to the examples above-mentioned. Various modifications are possible.

What is claimed is:

1. A stationary or moving blade of a gas turbine, consisting of a Cr-base heat resisting alloy which contains Cr as a main component element and at least one element selected from the group consisting of Re and W in an amount of from 1 atomic % to 40 atomic %.

2. The stationary or moving blade of a gas turbine according to claim 1, in the alloy is a binary alloy of Cr and Re or W, or a ternary alloy of Cr, Re and W.

3. A stationary or moving blade of a gas turbine, made of a binary Cr-W heat resisting alloy produced by dissolving materials, which contains Cr as a main component element and W in an amount of 25 atomic % to 40 atomic %.

4. A stationary or moving blade of a gas turbine, made of a binary Cr-W heat resisting alloy produced by dissolving materials, which contains Cr as a main component element and W in an amount of 10 atomic % to 30 atomic %.

5. A stationary or moving blade of a gas turbine, made of a binary Cr—Re heat resisting alloy produced by dissolving raw materials, which contains Cr as a main component element and Re in an amount of 10 atomic % or 30 atomic %.

* * * * *